US007233103B2

(12) United States Patent
Kijima et al.

(10) Patent No.: US 7,233,103 B2
(45) Date of Patent: Jun. 19, 2007

(54) IMAGE DISPLAY DEVICE

(75) Inventors: Yuuichi Kijima, Chosei (JP); Shigemi Hirasawa, Chiba (JP); Kenji Kato, Mobara (JP); Akira Hatori, Chiba (JP); Hiroshi Sasaki, Mobara (JP)

(73) Assignee: Hitachi Displays, Ltd., Chiba-ken (JP)

( * ) Notice: Subject to any disclaimer, the term of this patent is extended or adjusted under 35 U.S.C. 154(b) by 76 days.

(21) Appl. No.: 11/251,149

(22) Filed: Oct. 13, 2005

(65) Prior Publication Data

US 2006/0087217 A1 Apr. 27, 2006

(30) Foreign Application Priority Data

Oct. 22, 2004 (JP) ..... 2004-307722

(51) Int. Cl.
*H01J 1/62* (2006.01)

(52) U.S. Cl. ..... 313/495; 313/497; 313/496; 313/292

(58) Field of Classification Search ..... 313/495, 313/496, 497, 292
See application file for complete search history.

(56) References Cited

U.S. PATENT DOCUMENTS 5,734,224 A * 3/1998 Tagawa et al. ..... 313/493
6,979,243 B2 * 12/2005 Watanabe ..... 445/24

FOREIGN PATENT DOCUMENTS

JP 3241219 10/2001

* cited by examiner

*Primary Examiner*—David Bruce
*Assistant Examiner*—Conrad R. Blease
(74) *Attorney, Agent, or Firm*—Milbank, Tweed, Hadley & McCloy LLP

(57) ABSTRACT

The present invention provides an image display device which can realize the recycling at a low cost by shortening a disassembling time of a face substrate and a back substrate. In a support frame which is bonded and fixed to a face substrate and a back substrate by way of sealing materials respectively, a cut portion whose spatial region expands from the inside to the outside is integrally formed on an end surface at a corner portion thereof. To outer portions of the cut portions, the sealing materials 10*a*, 10*b* are not fixed.

13 Claims, 7 Drawing Sheets

IMAGE DISPLAY DEVICE

BACKGROUND OF THE INVENTION

1. Field of the Invention

The present invention relates to an image display device which makes use of the emission of electrons into a vacuum defined between a face substrate and a back substrate, and more particularly to the structure of a support body which holds and fixes a given gap between both substrates.

2. Description of the Related Art

A color cathode ray tube has been popularly used conventionally as an excellent display device which exhibits high brightness and high definition. However, along with the realization of high image quality of recent information processing device and television broadcasting, there has been a strong demand for a planar display (panel display) which can realize a light-weighted and thin display while ensuring the excellent properties such as high brightness and high definition.

As typical examples of such a planar display device, a liquid crystal display device, a plasma display device and the like have been put into practice. Further, particularly, with respect to the planar display device which can realize the high brightness, various types of panel display devices including an image display device which makes use of emission of electrons into a vacuum from electron sources (hereinafter referred to as "an electron emission type display device" or "a field emission type display device", hereinafter also referred to as "FED") and an organic EL display which is characterized by low power consumption are expected to be put into practice in near future.

Among these panel-type display devices, with respect to the electron emission type display device, the display device which has the electron emission structure proposed by C. A. Spindt, a display device which has the metal-insulator-metal (MIM) type electron emission structure, a display device which has the electron emission structure making use of an electron emission phenomenon based on a quantum tunneling effect (also referred to as surface conductive type electron sources), and a display device which makes use of an electron emission phenomenon which a diamond film, a graphite film and carbon nanotubes possess have been known.

Further, among these panel type display devices, the field emission type image display device is configured such that a back substrate which forms cathode lines having field emission type electron sources, control electrodes and the like on an inner surface thereof, and a face substrate which forms an anode and phosphors on an inner surface thereof which faces the back substrate in an opposed manner are laminated to each other by inserting a support frame between inner peripheral portions of both substrates and are hermetically sealed to form a panel, and a sealed space of the panel is held at a pressure lower than an external atmospheric pressure or in a vacuum state.

The above-mentioned control electrodes are arranged in a state that the control electrodes intersect the cathode lines by way of an insulation layer or with an insulation gap therebetween.

Further, in the above-mentioned control electrode, a single or a plurality of apertures which allow electrons from the electron sources formed on the cathode lines to pass therethrough are formed for every pixel. Further, to hold a distance between the back substrate and the face substrate to a distance of a given value, space holding members are interposed between the back substrate and the face substrate.

Here, the distance holding members are formed of a thin plate made of glass or ceramics, for example, and are mounted in an erected manner at positions which avoid the pixel.

FIG. 10 is a cross-sectional view of an essential part for explaining the constitution of an image display device which constitutes this kind of conventional panel type display device. The image display device is constituted of a back substrate 2 which mounts a plurality of electron emission elements 5 on a surface thereof, a face substrate 1 which is arranged to face the back substrate 2 in an opposed manner and, at the same time, mounts image forming members 6 on which images are formed due to the irradiation of electron beams emitted from the electron emission elements 5, a frame-like support frame 3 which is interposed between the back substrate 2 and the face substrate 1 and supports peripheral portions of the back substrate 2 and the face substrate 1, and spacers (distance holding members) 4 which are arranged as support columns between the face substrate 1 and the back substrate 2.

In the image display device having such a constitution, as shown in FIG. 11 which is an enlarged cross-sectional view of the essential part, between the peripheral portions of the face substrate 1 and the back substrate 2 which face each other in an opposed manner, the support frame 3 which is formed by assembling glass members having an approximately rectangular cross section into a frame shape has both end surfaces thereof adhered to the face substrate 1 and the back substrate 2 using a sealing material such as a frit glass material, for example, thus adhering and fixing the support frame 3 to the face substrate 1 and the back substrate 2. Further, in the inside of the peripheral portion, the spacers 4 which are formed of a glass member are adhered and fixed to the face substrate 1 and the back substrate 2 while interposing a fixing material made of frit glass or the like, for example (frit glass) between the spacers and both end surfaces. Due to such a constitution, the atmospheric pressure resistance strength and the impact resistance property can be enhanced. This type of image display device is disclosed in Japanese Patent No. 3241219 (Japanese Patent Laid-open Hei 7(1995)-230776 (patent document 1)) or the like.

SUMMARY OF THE INVENTION

However, the image display device described in patent document 1 adopts the structure in which the support frame 3 has both end surfaces thereof completely adhered and fixed to the face substrate 1 and the back substrate 2 by way of the sealing material. Accordingly, for example, when a defective place is generated at a portion in the inside of the panel and one or both of the face substrate 1 and the back substrate 2 is to be reused, the image display device is disassembled (separated) in two from the support frame portion which seals the face substrate 1 and the back substrate 2. In such an operation, there arises a drawback that either one or both of the substrates are broken and it becomes extremely difficult to reuse these substrates as non-defective parts. In other words, the panel structure which takes the recycling into consideration has not been adopted.

Further, the disassembling (separation) of the face substrate 1 and the back substrate 2 in a state that both substrates receive substantially no damage requires a considerable operation time thus giving rise to a drawback that a manufacturing cost is pushed up.

Accordingly, the present invention has been made to overcome the above-mentioned conventional drawbacks and it is an object of the present invention to provide an image display device which can shorten a disassembling time and can realize the recycling at a low cost.

To achieve the above-mentioned object, an image display device according to the present invention is constituted of a face substrate which forms an anode and phosphors on an inner surface thereof, a back substrate which includes a plurality of electron sources on an inner surface thereof and is arranged to face the face substrate in an opposed manner with a given distance therebetween, and a support body which is interposed between the face substrate and the back substrate in a state that the support body surrounds a display region and holds the given distance, wherein a cut portion whose spatial region is expanded from the inside to the outside is formed on an outside of at least one end surface out of both end surfaces on a face substrate side and a back substrate side of the support body. Due to such a constitution, it is possible to easily apply a mechanical strain to the cut portion and hence, the above-mentioned drawbacks of the related art can be overcome.

Further, in another image display device according to the present invention, in the above-mentioned constitution, it is preferable to form the cut portion on at least one corner portion of the support body. Due to such a constitution, it is possible to easily apply the mechanical strain to the cut portion at the time of disassembling and hence, the above-mentioned drawbacks of the related art can be overcome.

Further, in another image display device according to the present invention, in the above-mentioned constitution, it is preferable to form the cut portion on the end surface of either one of the face substrate side and the back substrate side. Due to such a constitution, it is possible to easily apply the mechanical strain to the cut portion at the time of disassembling and hence, the above-mentioned drawbacks of the related art can be overcome.

Further, in another image display device according to the present invention, in the above-mentioned constitution, it is preferable to form the cut portion on at least one side portion of the support body. Due to such a constitution, it is possible to easily apply the mechanical strain to the cut portion at the time of disassembling and hence, the above-mentioned drawbacks of the related art can be overcome.

Further, in another image display device according to the present invention, in the above-mentioned constitution, it is preferable to form the cut portion in the support body in a state that a depth of the cut portion (a size taken parallel to the end surface of the support body and a size in the diagonal direction of a rectangular plane surrounded by the support body) is smaller than a width size of an end surface of the support body. Due to such a constitution, it is possible to easily apply the mechanical strain to the cut portion at the time of disassembling and hence, the above-mentioned drawbacks of the related art can be overcome.

Here, it is needless to say that the present invention is not limited to the above-mentioned embodiments and constitutions described later and various modifications can be made without departing from the technical concept of the present invention.

According to the present invention, by forming the cut portion on at least one portion of the support body, it is possible to easily apply the mechanical strain to the cut portion at the time of disassembling and hence, it is possible to disassemble the image display device in a short period while minimizing a damage quantity of one or both of the face substrate and the back substrate. Accordingly, it is possible to obtain extremely excellent advantageous effect such as the realization of the recycling at a low cost by shortening the disassembling time.

DESCRIPTION OF THE PREFERRED EMBODIMENTS

Embodiments of the present invention are explained in detail in conjunction with attached drawings hereinafter.

[Embodiment 1]

Figure 1:
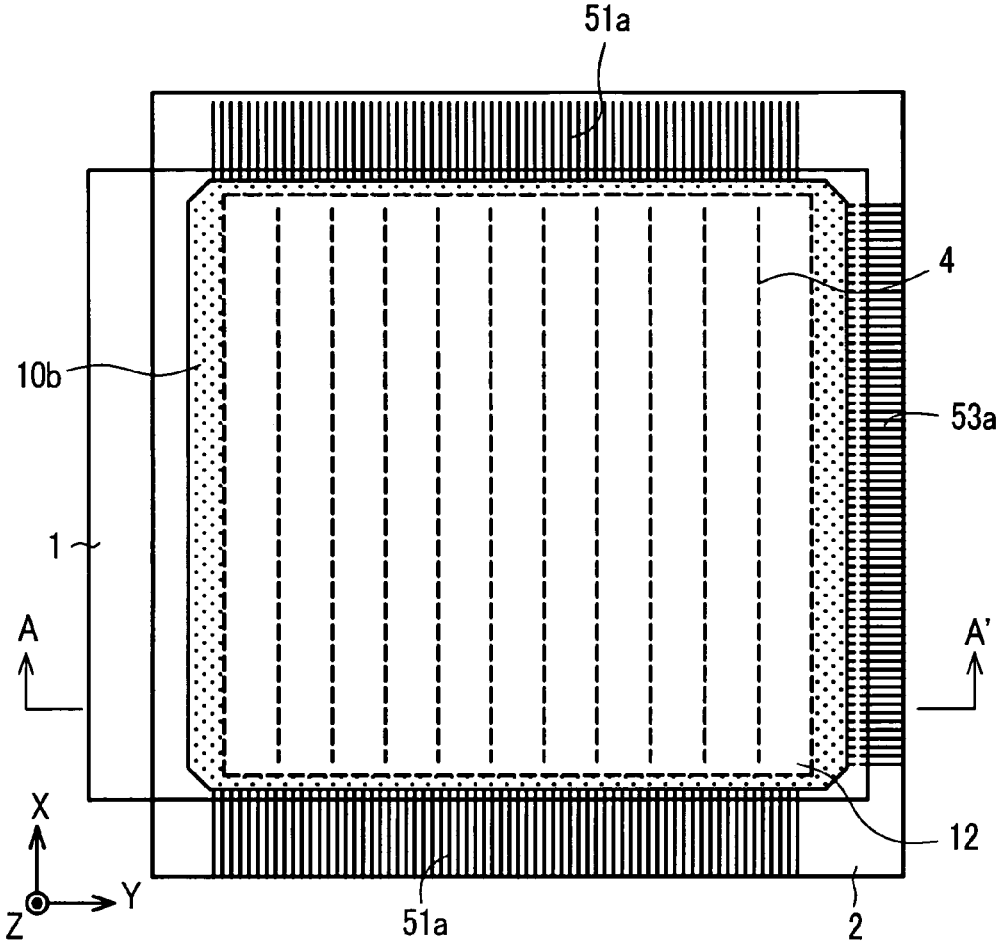
FIG. 1 is a schematic plan view showing the constitution according to an embodiment 1 of an image display device according to the present invention.
Figure 2:
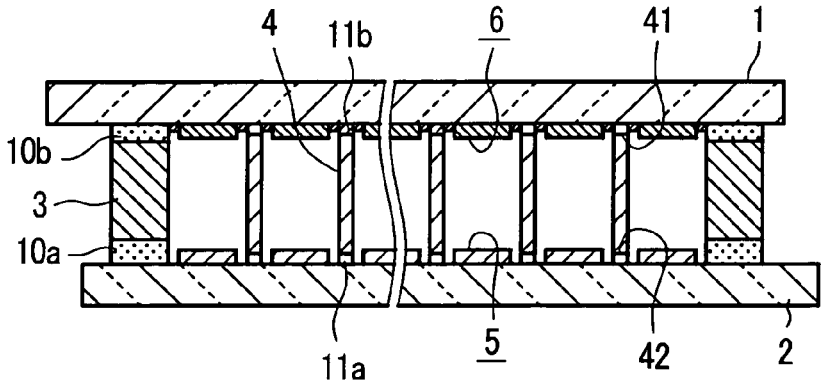
FIG. 2 is an enlarged cross-sectional view of an essential part taken along a line A–A' in FIG. 1.

FIG. 1 is a plan view of an essential part for explaining the schematic constitution of an electron emission type display device of an embodiment 1 of an image display device according to the present invention, and FIG. 2 is an enlarged cross-sectional view of an essential part taken along a line A–A' in FIG. 1. In FIG. 1 and FIG. 2, numeral 1 indicates a face substrate which is made of a light-transmitting glass plate material and numeral 2 indicates a back substrate which is made of a light transmitting glass plate material in the same manner as the face substrate 1 or made of a ceramics plate material such as alumina. These face substrate 1 and the back substrate 2 are formed of an insulation substrate having a plate thickness of approximately 3 mm.

Further, numeral 3 indicates a support frame which is formed into a support body by cutting a molded body made of glass or a frit glass material and assembling, adhering and fixing cut members into a frame shape, wherein the support body 3 also functions as an outer frame. The support frame 3 is installed by adhesion and fixing at a peripheral portion between the face substrate 1 and the back substrate 2 using sealing materials 10*a*, 10*b* described later and a distance between the face substrate 1 and the back substrate 2 is held at a given size, for example, approximately 3 mm.

Figure 3:
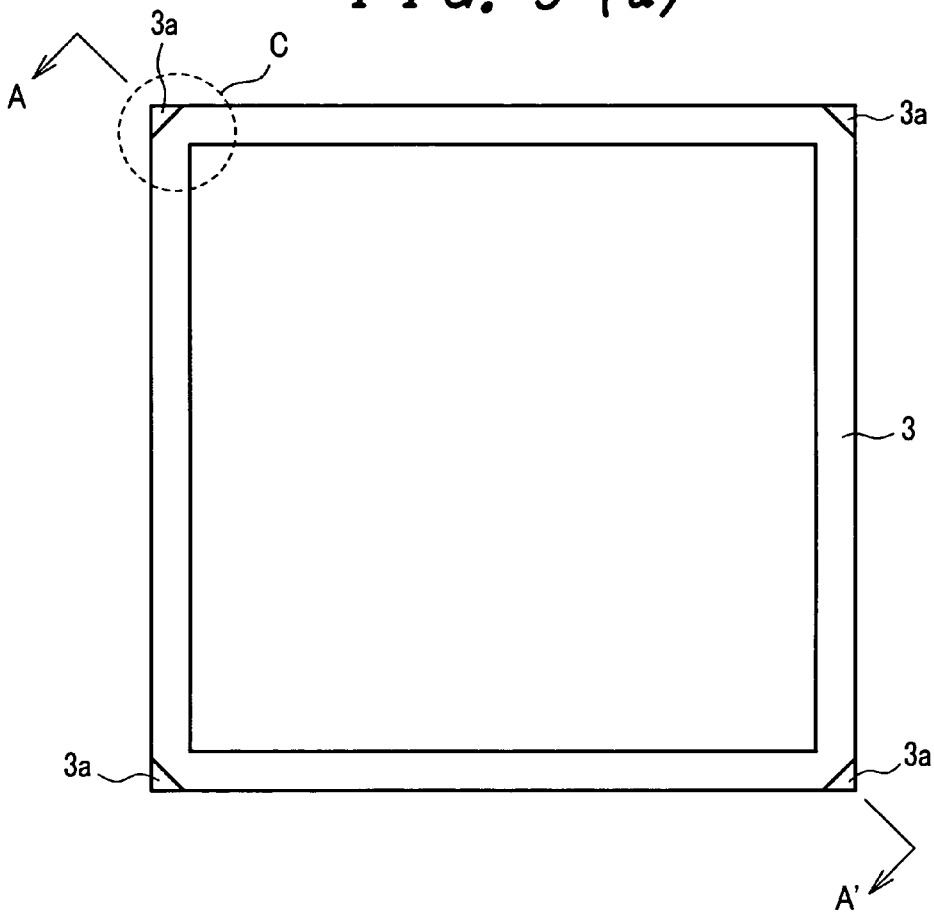
FIG. 3A, FIG. 3B and FIG. 3C are views showing the constitution of a support frame shown in FIG. 2.
Figure 3:
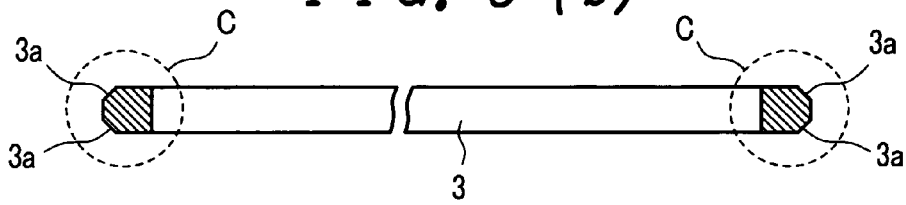
Figure 3:
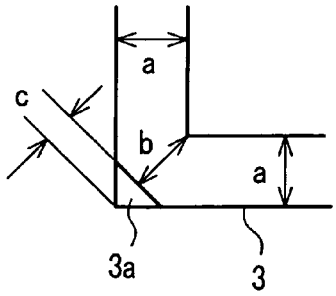

FIG. 3A, FIG. 3B and FIG. 3C are views for explaining the constitution of the above-mentioned support frame 3, wherein FIG. 3A is a schematic plan view as viewed from above, FIG. 3B is a cross-sectional view taken along a line A–A' in FIG. 3A, and FIG. 3C is an enlarged plan view of a corner portion C in FIG. 3A. In FIG. 3A, FIG. 3B and FIG. 3C, at four corner portions C of the support frame 3, as shown in FIG. 3A, on portions of a face-substrate-1-side end surface and a back-substrate-2-side end surface, cut portions 3*a* are integrally formed, wherein the cut portions 3*a* are obliquely cut to form spatial regions extending outwardly from the inside (a gap between the face substrate and the back substrate). It is sufficient that a width of the sealing portion is substantially equal between a side portion and the corner portion C of the support frame 3. Accordingly, a shape of the cut portion 3*a* is, as shown in FIG. 3C, formed in a state that a triangular pyramid portion is cut away such that a width "a" of the side portion at the sealing portion of the support frame 3 and a size "b" which extends outwardly from the inside at the corner portion C at the sealing portion of the support frame 3 become substantially equal (a=b). That is, at the corner portion C of the support frame 3, a thickness thereof is not fixed and is gradually decreased outwardly at an outer portion thereof. Here, the thickness of the above-mentioned support frame 3 is a size in the direction orthogonal to the face-substrate-side end surface (sealing portion) and the back-substrate-side end surface (sealing portion) of the support frame 3. For example, when a width "a" of the side portion at the sealing portion of the support frame 3 is approximately 5 mm, the cut portion 3*a* having a depth "c" of approximately 2 mm is formed outside at the corner portion C. Here, the depth "c" of the above-mentioned cut portion 3*a* is a size in the diagonal direction of a rectangular plane which is parallel to the face-substrate-side end surface (sealing portion) and the back-substrate-side end surface (sealing portion) of the support frame and is surrounded by the support frame. Further, a width "b" of the sealing portion of the above-mentioned corner portion C is a size in the diagonal direction on the rectangular plane surrounded by the support frame.

Figure 4:
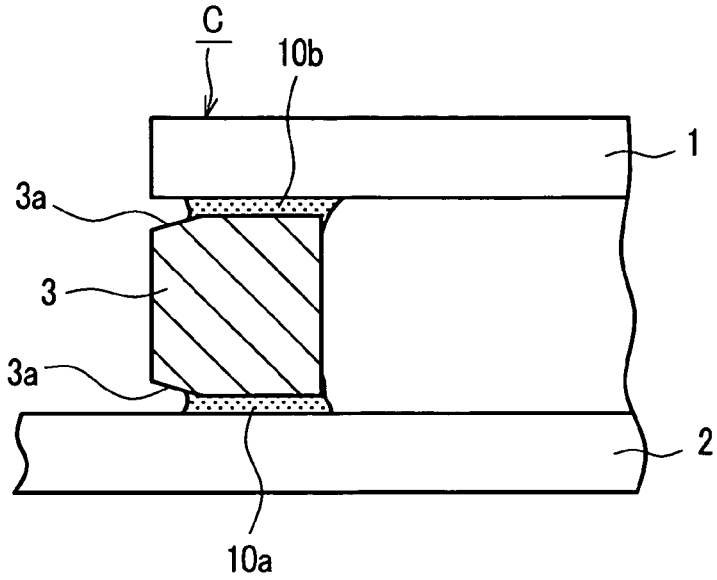
FIG. 4 is an enlarged cross-sectional view of an essential part showing a corner portion of the support frame of the image display device according to the present invention.

Accordingly, the support frame 3 which is adhered and fixed between the face substrate 1 and the back substrate 2 by way the sealing materials 10*b*, 10*a* adopts the structure in which, at respective four corner portions C, the outwardly formed cut portions 3*a* are exposed to the outside and the outside portions of the cut portions 3*a* are not fixedly secured by the sealing materials 10*a*, 10*b*. That is, the support frame 3 adopts the structure in which the support frame projects outwardly (on the side opposite to the display region) with respect to the sealing materials in the direction along the face-substrate-side end surface (sealing portion) and the back-substrate-side end surface (sealing portion) as shown in FIG. 4 which is an enlarged cross-sectional view of the corner portion C. Further, spatial regions are formed between the end surfaces of the support frame and the face substrate or the back substrate.

Further, numeral 4 shown in FIG. 2 indicates plate-like spacers which constitute distance holding members, wherein the spacers 4 are formed by cutting a thin glass plate or ceramics plate material made of alumina having a thickness of approximately 0.1 mm or less, for example, such that the spacers 4 have a width (height size) of approximately 3 mm. The spacers 4 extend substantially vertically to substrate surfaces of the face substrate 1 and the back substrate 2, wherein the spacers 4 extend in one direction (x direction) and are arranged in parallel in another direction (y direction) in plural rows, and are fixedly arranged using fixing materials 11*a*, 11*b* described later. The spacers 4 hold a distance between the face substrate 1 and the back substrate 2 at a given size in cooperation with the support frame 3.

Numeral 5 indicates a group of electron emitting elements 5, wherein the group of electron emitting elements 5 is constituted of cathode lines, electron sources and control electrodes, and the cathode lines, the electron sources and the control electrodes are arranged at given intervals on the back substrate 2. A plurality of cathode lines extend in one direction (x direction) and are arranged in parallel in another direction (y direction) on an inner surface of the back substrate 2. End portions of the cathode lines are divided to two sides of the back substrate 2 and are pulled to the outside of a hermetic sealing portion as cathode-line lead lines 51*a*. The cathode lines are formed, for example, by a vapor deposition method or the like or by a method in which a silver paste in which low-melting-point glass which exhibits the insulation property is mixed into conductive silver particles having a particle size of 1 to 5 μm is printed as a film having a large thickness, and the paste is baked at a temperature of approximately 600° C.

Further, the control electrodes are arranged above the cathode lines in an insulated manner in a state that the control electrodes are insulated from the cathode lines and end portions of the control electrodes are pulled out to the outside of the hermetically sealing portion at another side of the back substrate 2 as control electrode lead lines 53*a*.

Further, the group of electron emitting elements 5 which are arranged at a given interval on the back substrate 2 is formed of electron sources selected from a group consisting of metal-insulator-metal (MIM) type electron emitting elements, electron emitting elements which make use of an electron emission phenomenon based on a quantum tunneling effect (also referred to as surface conductive type electron sources), and diamond films, graphite films and carbon nanotubes.

Further, numeral 6 indicates an image forming member and the image forming member 6 is formed of a phosphor film, a metal back film which is applied to the phosphor film and a black matrix (BM) film and is arranged on an inner surface of the face substrate 1.

Further, numeral 10*a* indicates the sealing material which seals the back substrate 2 and one end surface of the support frame 3, wherein the sealing material 10*a* is formed of crystallized frit glass which contains PbO, $B_2O_3$ and ZnO as main components, for example. Further, numeral 10*b* indicates the sealing material which seals the face substrate 1 and another end surface of the support frame 3, wherein the sealing material 10*b* is formed of amorphous frit glass which contains PbO and $B_2O_3$ as main components, for example.

The face substrate 1 and the back substrate 2 are arranged and stacked on upper and lower end surfaces of the support frame 3 in the z direction by way of these sealing materials 10*a*, 10*b*, wherein the peripheral portions of the face substrate 1 and the back substrate 2 are hermetically sealed. Further, a portion which is surrounded by the support frame 3, the face substrate 1 and the back substrate 2 constitutes an image display region 12 shown in FIG. 1 and the display region 12 portion has an inside thereof held in a vacuum state.

Here, the hermetic sealing which is performed by way of the sealing materials 10*a*, 10*b* is performed by a following method, for example. That is, the hermetic sealing is performed at a temperature of approximately 430° C., for example, in a nitrogen atmosphere and, thereafter, the sealing materials 10*a*, 10*b* are heated at a temperature of approximately 350° C. and the atmosphere is evacuated to seal the inside of the image display region 12 in a vacuum. Here, the above-mentioned z direction is the direction which is orthogonal to the face substrate 1 and the back substrate 2 which are overlapped to each other.

Further, numerals 11*a*, 11*b* indicate fixing materials which respectively fix the spacers 4, the back substrate 2 and the face substrate 1. The fixing material 11*a* is, for example, a substance which possesses hysteresis property and is formed of crystallized frit glass which contains $B_2O_3$, PbO and ZnO as main components. With the use of the fixing material 11*a*, the back substrate 2 and lower end surfaces 42 of the spacers 4 are fixed to each other. Further, the fixing material 11*b* is, for example, formed of amorphous frit glass which contains $SiO_2$, $B_2O_3$ and PbO as main components. With the use of the fixing material 11*b*, the face substrate 1 and upper end surfaces 41 of the spacers 4 are fixed to each other. For example, out of these fixing material 11*a* and fixing material 11*b*, the fixing material 11*b* is formed of the amorphous frit glass having hardness which is substantially equal to or lower than hardness of the spacers 4.

In such a constitution, electrons which are emitted from the electron sources arranged on the cathode lines are controlled by electron passing apertures formed in the control electrodes to which a grid voltage of approximately 100V is applied, pass through the electron passing apertures, are directed to an image forming member to which an anode voltage of several KV to 10 and some KV is applied, pass through the metal back layer (anode), and impinge on the phosphor layer so as to allow the phosphors to emit light and hence, a desired display is performed on a visible image screen. Further, unit pixels are arranged at intersecting portions between the cathode lines and the control electrodes in a matrix array and a display region is formed of the pixels arranged in a matrix array. In general, a color pixel is formed of a group of three unit pixels of red (R), green (G) and blue (B).

Figure 5:
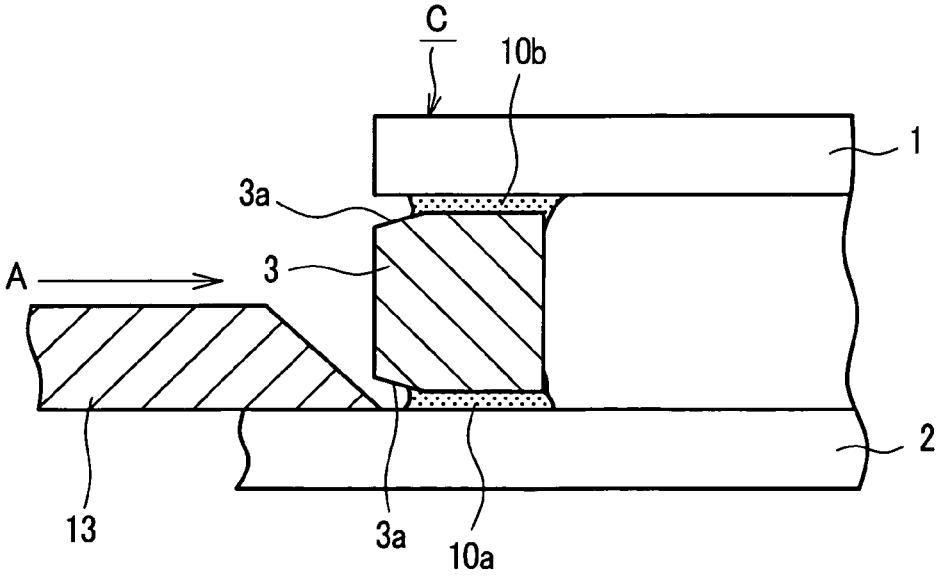
FIG. 5 is an enlarged cross-sectional view of an essential part showing a disassembling means of the corner portion of the support frame shown in FIG. 4.

In the image display device having such a constitution, in the support frame 3 which seals the face substrate 1 and the back substrate 2, as shown in FIG. 4, the cut portions 3*a* are integrally formed on portions of respective four corner portions C in a state that the cut portion 3*a* is formed by cutting the portion of each corner portion C in the oblique direction such that the a spatial region (the gap between the face substrate and the back substrate) is increased toward the outside from the inside. Due to such a constitution, at the time of disassembling the image display device, as shown in FIG. 5 which is an enlarged cross-sectional view of the essential part, it is possible to easily insert a distal end portion of a blade 13 from the outside to the cut portion 3*a*. Further, by applying a mechanical stress to a body of the blade 13, it is possible to easily apply a mechanical strain to the cut portion 3*a* and hence, the support frame 3 is peeled off from the back substrate 2 whereby the image display device is two-split into the back substrate 2 and the face substrate 1 to which the support frame 3 is adhered. Accordingly, either one or both of the face substrate 1 and the back substrate 2 can be disassembled substantially without damaging the substrates 1, 2 and hence, it is possible to take out the disassembled substrates as non-defective parts.

Here, to facilitate the insertion of a distal end portion of the above-mentioned blade 13, it is preferable to set a depth "c" of the cut portion 3*a* explained in conjunction with FIG. 3C to 0.3 mm or more.

However, when the depth "c" of the above-mentioned cut portion 3*a* is excessively large, the sealing-material applied region in the corner portion C of the support frame 3 becomes narrow thus giving rise to possibilities that an adhesive strength of the sealing portion is lowered, leaking of vacuum is generated and the like. To ensure the reliability with respect to these drawbacks, it is preferable to set an upper limit of the depth "c" of the above-mentioned cut portion 3*a* such that the width "b" of the sealing portion at the corner potion C explained in conjunction with FIG. 3C becomes 3 mm or more.

Further, by inserting the distal end portion of the blade 13 into the cut portion 3*a* of the support frame 3 sealed to the face substrate 1 in place of the disassembling means shown in FIG. 5, it is also possible to facilitate the applying of the mechanical strain to the cut portion. Accordingly, the support frame 3 can be peeled off from the face substrate 1 in the same manner as the above and hence, the image display device is two-split into the face substrate 1 and the back substrate 2 to which the support frame 3 is fixed. Accordingly, either one or both of the face substrate 1 and the back substrate 2 can be easily disassembled substantially without damaging the substrates 1, 2 and hence, it is possible to take out the disassembled substrates as non-defective parts.

[Embodiment 2]

Figure 6:
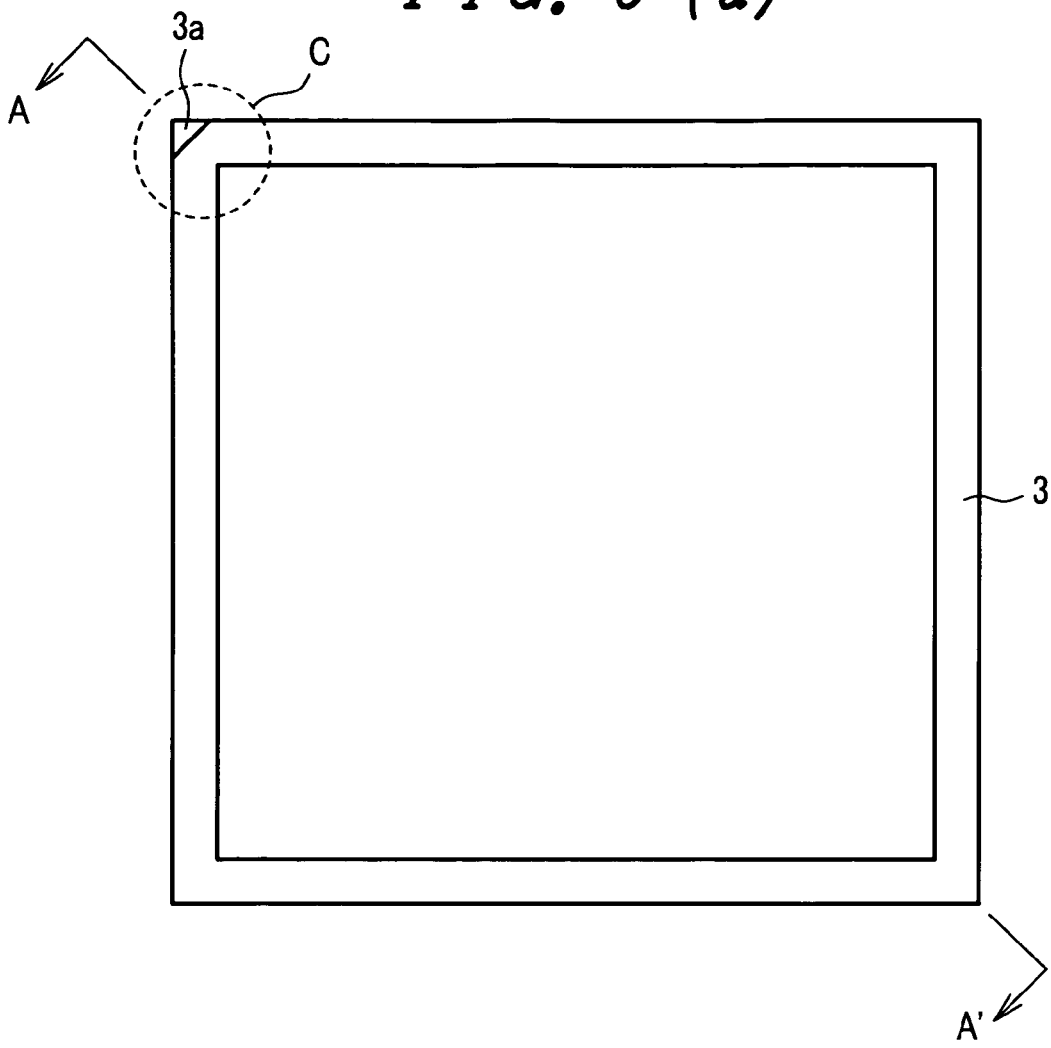
FIG. 6A and FIG. 6B are views showing the constitution of a support frame according to an embodiment 2 of the image display device according to the present invention.
Figure 6:
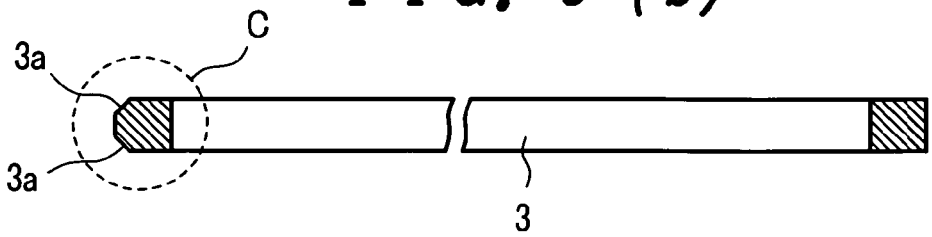

FIG. 6A to FIG. 6B are views showing the constitution of a support frame for explaining the embodiment 2 of the image display device according to the present invention, wherein FIG. 6A is a schematic plan view as viewed from above, and FIG. 6B is a cross-sectional view taken along a line A–A' in 6A. The constitution which makes this embodiment shown in FIG. 6A and FIG. 6B different from the embodiment shown in FIG. 3A, FIG. 3B and FIG. 3C lies in that, among four corner portions of the support frame 3, on respective portions of a face-substrate-1-side and a back-substrate-2-side of only one corner portion, cut portions 3*a* are integrally formed, wherein the cut portions 3*a* are obliquely cut. In this embodiment, sizes of the cut portions 3*a* are substantially equal to sizes of the cut portions 3*a* in the embodiment 1. Here, the image display device adopts the structure in which the cut portions 3*a* are not formed on three remaining corner portions.

[Embodiment 3]

Figure 7:
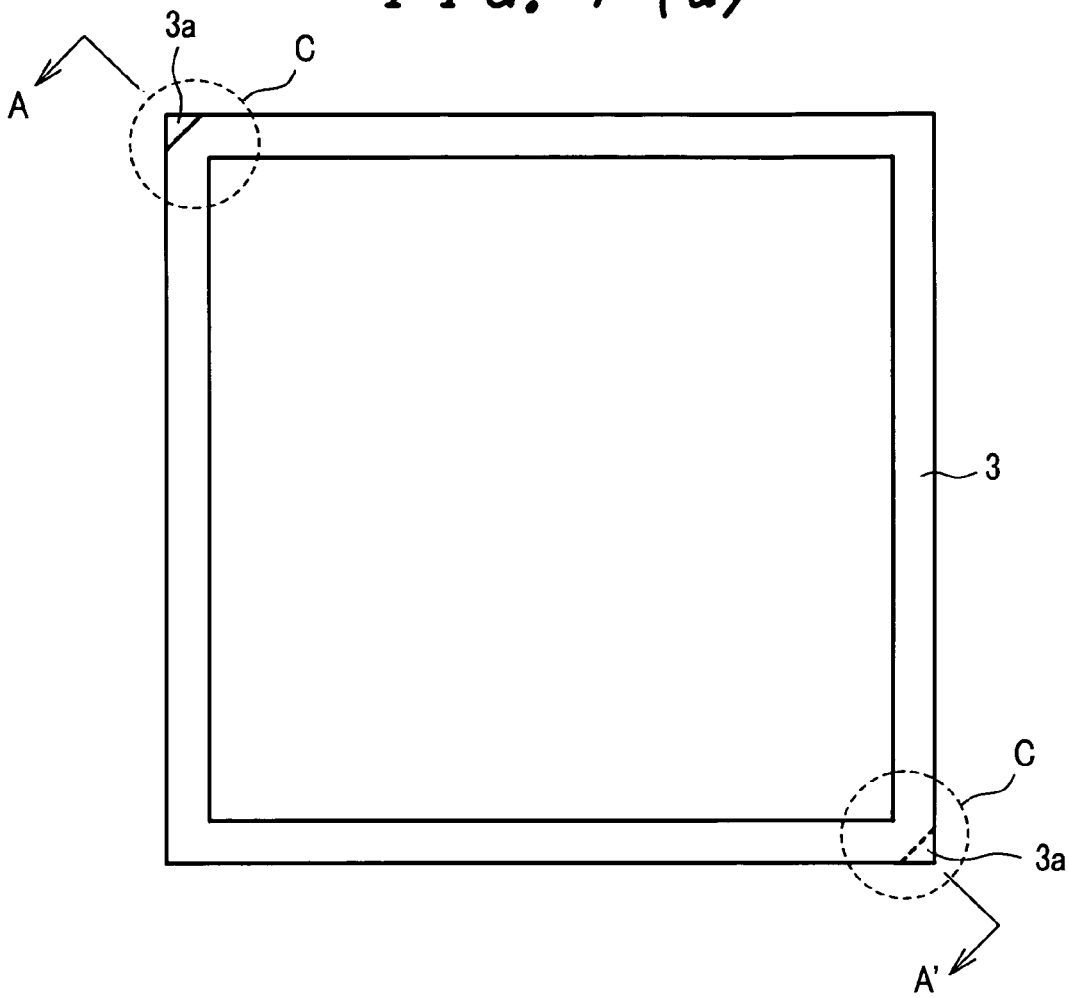
FIG. 7A and FIG. 7B are views showing the constitution of a support frame according to an embodiment 3 of the image display device according to the present invention.
Figure 7:
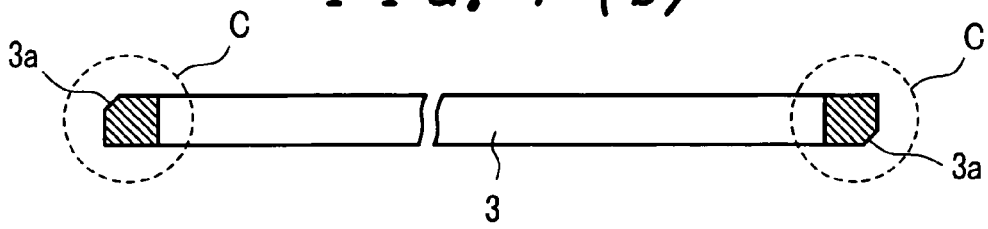

FIG. 7A to FIG. 7B are views showing the constitution of a support frame for explaining the embodiment 3 of the image display device according to the present invention, wherein FIG. 7A is a schematic plan view as viewed from above, and FIG. 7B is a cross-sectional view taken along a line A–A' in 7A. The constitution which makes this embodiment shown in FIG. 7A and FIG. 7B different from the embodiment shown in FIG. 3A, FIG. 3B and FIG. 3C lies in that, among four corner portions of the support frame 3, with respect to the corner portions C which are arranged to face each other in the diagonal direction, for example, the cut portion 3*a* is integrally formed on a face-substrate-1-side end surface (sealing portion) at one corner portion C and the cut portion 3*a* is integrally formed on a back-substrate-2-side end surface (sealing portion) at another corner portion C. In this embodiment, sizes of the cut portions 3*a* are substantially equal to sizes of the cut portions 3*a* in the embodiment 1. Here, the image display device adopts the structure in which the cut portions 3*a* are not formed on two remaining corner portions.

FIG. 8A and FIG. 8B are views for explaining the constitution of a support frame for explaining the embodiment 4 of the image display device according to the present invention, wherein FIG. 8A is a schematic plan view as viewed from above and FIG. 8B is a cross-sectional view taken along a line A–A' in FIG. 8A. In FIG. 8A and FIG. 8B, with respect to the support frame 3, out of four respective sides which constitute the frame structure, cut portions 3*a* are integrally formed on the sides which face each other in an opposed manner, wherein the cut portions 3*a* are obliquely cut to form spatial regions extending outwardly from the inside (a gap between the face substrate and the back substrate). A shape of the cut portion 3*a* is, as shown in FIG. 8A, formed in a state that a triangular prism portion is cut away such that a size "d" of the cut portion 3*a* of the support frame 3 extending in the outward direction from the inside has a relationship a>d assuming a width of the side portion in the sealing portion of the support frame 3 as "a". For example, when the width "a" of the side portion at the sealing portion of the support frame 3 is approximately 5 mm, the cut portion 3*a* having the width "d" of approximately 2 mm is provided outside the side portion.

Here, it is preferable to set a range of the width "d" of the cut portion 3*a* in the same manner as the setting of the depth "c" of the cut portion 3*a* explained in conjunction with FIG. 3C and FIG. 4.

Figure 9:
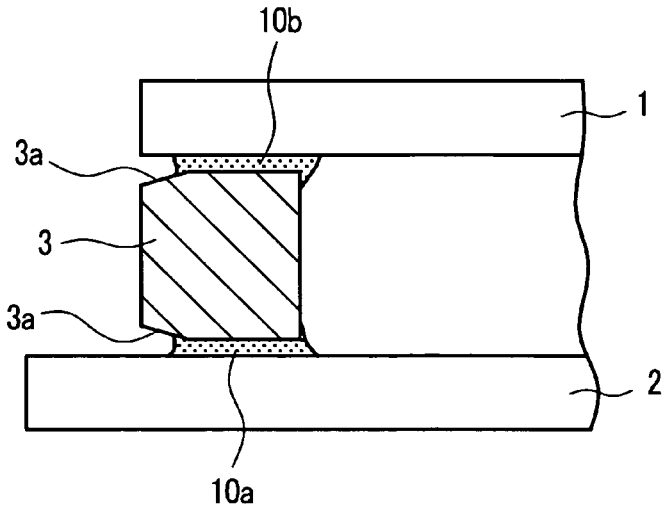
FIG. 9 is an enlarged cross-sectional view showing the structure of a side portion of a support frame of the image display device according to the present invention.
Figure 10:
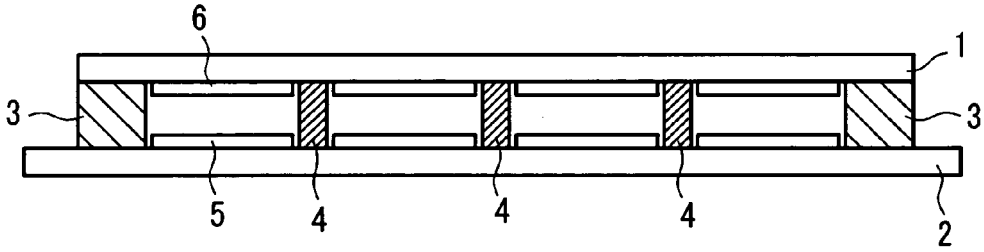
FIG. 10 is a cross-sectional view of an essential part showing the basic structure of a conventional image display device.
Figure 11:
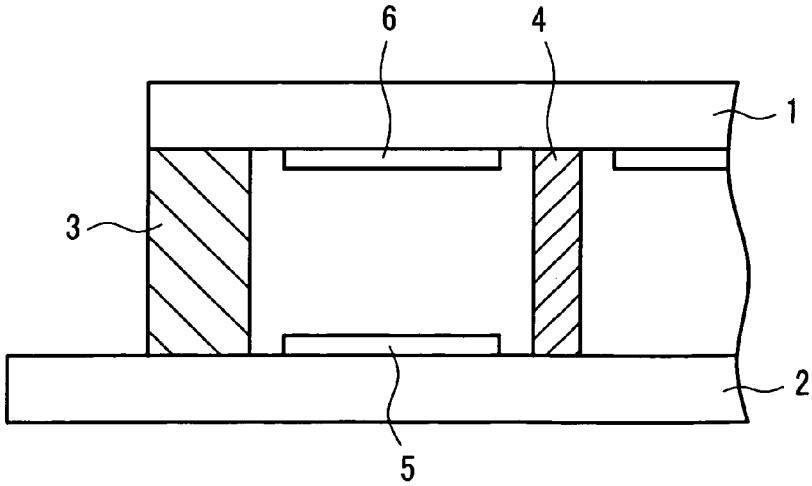
FIG. 11 is an enlarged cross-sectional view of an essential part for explaining a drawback of the related art of the image display device shown in FIG. 10.

The support frame 3 which is formed in the above-mentioned manner is adhered and fixed between the face substrate 1 and the back substrate 2 by way the sealing materials 10*b*, 10*a* as shown in FIG. 9 which is an enlarged cross-sectional view of an essential part. These cut portions 3*a* are exposed to the outside and the outside portions 3*a* of the cut portions are not fixedly secured by the sealing materials 10*a*, 10*b*.

According to such a constitution, with the use of the disassembling means with the blade 13 explained in conjunction with FIG. 5, by inserting the distal end portion of the blade 13 into the cut portion 3*a* of the support frame 3 sealed to the face substrate 1 or the back substrate 2, the support frame 3 can be peeled off from the face substrate 1 or the back substrate 2 in the same manner as the above and hence, the image display device is two-split into the face substrate 1 and the back substrate 2. Accordingly, either one or both of the face substrate 1 and the back substrate 2 can be easily disassembled substantially without damaging the substrates 1, 2.

Figure 8:
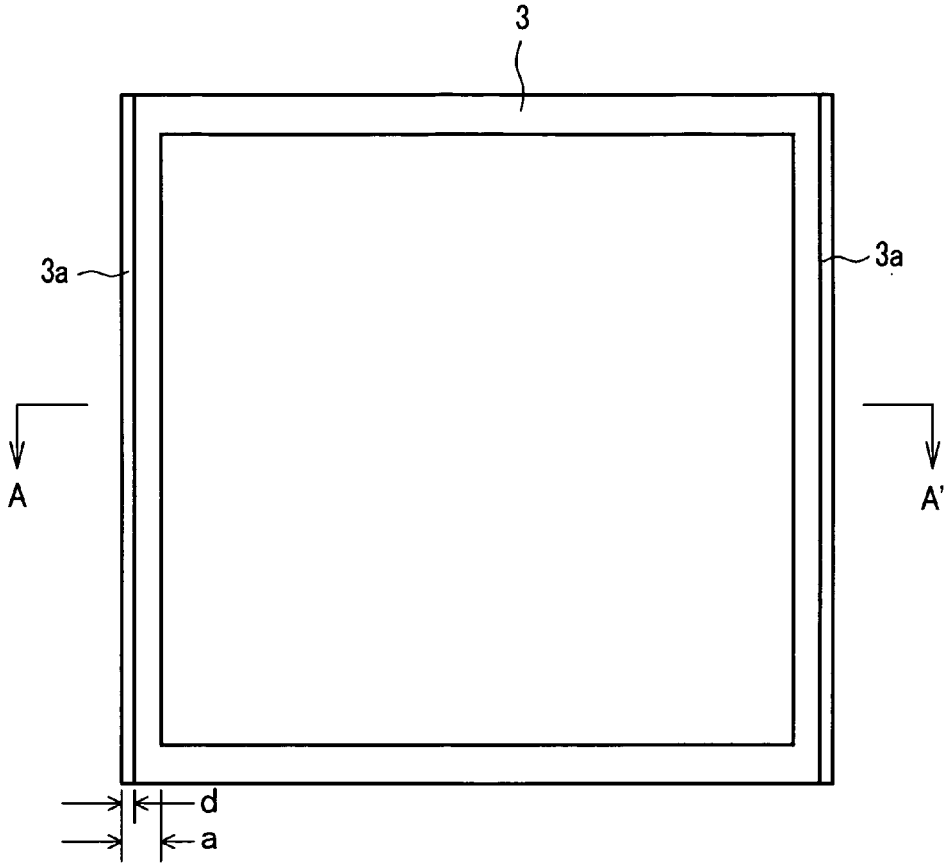
FIG. 8A and FIG. 8B are views showing the constitution of a support frame according to an embodiment 4 of the image display device according to the present invention.
Figure 8:
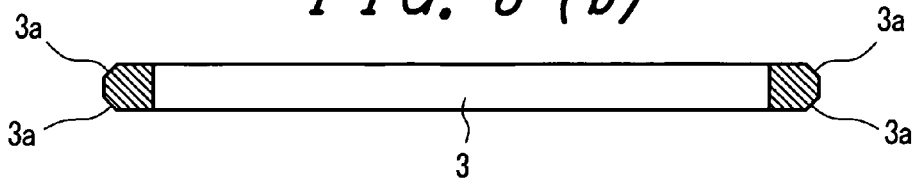

In the image display device having such a constitution, on the support frame 3 which seals the face substrate 1 and the back substrate 2, as shown in FIG. 8, cut portions 3*a* are integrally formed in a state that the cut portion 3*a* is formed by cutting the portion of each side portion. Due to such a constitution, at the time of disassembling the image display device, in the same manner as the above, it is possible to easily insert a distal end portion of a blade 13 into the cut portion 3*a* from the outside. Further, by applying a mechanical stress to a body of the blade 13, it is possible to easily apply a mechanical strain to the cut portion 3*a* and hence, the support frame 3 is peeled off from the face substrate 1 or the back substrate 2 whereby the image display device can be two-split into the face substrate 1 and the back substrate 2 or the back substrate 2 to which the support frame 3 is fixed and the face substrate 1. Accordingly, either one or both of the face substrate 1 and the back substrate 2 can be disassembled substantially without damaging the substrates 1, 2 and hence, it is possible to take out the disassembled substrates as non-defective parts.

Here, although the explanation has been made with respect to the case in which the cut portions 3*a* are respectively formed on the face-subustrate-1 side and the back-substrate-2 side at the opposedly-facing side portions of the support frame 3, the cut portions 3*a* may be formed either one of these side portions of the support frame 3. Further, the cut portions 3*a* may be formed on either one of the face-subustrate-1 side and the back-substrate-2 side.

Here, in the above-mentioned respective embodiments, although the explanation has been made with respect to the case in which the support frame 3 is formed in a square shape, it is needless to say that the present invention is not limited to such a shape and a support frame having inner and outer frame shape with curved surfaces can also obtain substantially same advantageous effects by providing the exactly same constitution to the support frame.

Further, in the above-mentioned respective embodiments, although the explanation has been made with respect to the case in which the sealing materials which seal the face substrate 1, the support frame 3 and the back substrate 2 are different in composition from each other between the face-substrate-1-side and the back-substrate-2-side, the present invention is not limited to such a case and it is possible to obtain the substantially same advantageous effects by using sealing materials having the same composition.

Further, in the above-mentioned respective embodiments, although the explanation has been made with respect to the case in which the fixing materials which fix the face substrate 1, the spacers 4 and the back substrate 2 are different in composition from each other between the face-substrate-1-side and the back-substrate-2-side, the present invention is not limited to such a case and it is possible to obtain the substantially same advantageous effects by using fixing materials having the same composition.

Further, in the above-mentioned embodiments, the explanation has been made with respect to the case in which as the image display device to which the present invention is applied, the FED which uses the face substrate including the phosphors and the black matrix on an inner surface thereof and the anode on a back surface of the phosphors and the black matrix is adopted. However, the present invention is not limited to such an application and it is possible to obtain the exactly same advantageous effects as described above by applying the present invention to a plasma display (PDP) or a panel type display which includes electrons emission sources of a type different from the plasma display.

What is claimed is:

1. An image display device comprising:

a face substrate which forms an anode and phosphors on an inner surface thereof;

a back substrate which includes a plurality of electron sources on an inner surface thereof and is arranged to face the face substrate in an opposed manner with a given distance therebetween; and a frame-like support body which is interposed between the face substrate and the back substrate in a state that the support body surrounds a display region and holds the given distance, wherein the image display device includes a cut portion which forms a spatial region on an outside of at least one end surface out of both end surfaces on a face substrate side and a back substrate side of the support body.

2. An image display device according to claim 1, wherein the cut portion is formed on a corner portion of the support body.

3. An image display device according to claim 2, wherein the cut portion is formed on the end surface of either one of the face substrate side and the back substrate side.

4. An image display device according to claim 1, wherein the cut portion is formed on a side portion of the support body.

5. An image display device according to claim 1, wherein a depth of the cut portion is set smaller than a width size of the end surface of the support body.

6. An image display device comprising:

a face substrate which forms an anode and phosphors on an inner surface thereof;

a back substrate which includes a plurality of electron sources on an inner surface thereof and is arranged to face the face substrate in an opposed manner with a given distance therebetween; and a frame-like support body which is interposed between the face substrate and the back substrate in a state that the support body surrounds a display region, is bonded and fixed to the face substrate and the back substrate by way of sealing materials respectively, and holds the given distance, wherein the support body includes a portion which projects to a side opposite to the display region with respect to the sealing materials.

7. An image display device according to claim 6, wherein the projecting portion of the support body is formed on a corner portion of the support body.

8. An image display device according to claim 6, wherein the projecting portion of the support body is formed on either one of the face substrate side and the back substrate side.

9. An image display device according to claim 6, wherein the projecting portion of the support body is formed on a side portion of the support body.

10. An image display device comprising:

a face substrate which forms an anode and phosphors on an inner surface thereof;

a back substrate which includes a plurality of electron sources on an inner surface thereof and is arranged to face the face substrate in an opposed manner with a given distance therebetween; and a frame-like support body which is interposed between the face substrate and the back substrate in a state that the support body surrounds a display region, is bonded and fixed to the face substrate and the back substrate by way of sealing materials respectively, and holds the given distance, wherein the image display device forms a spatial region between at least one end surface out of both end surfaces on a face substrate side and a back substrate side of the support body and the face substrate and the back substrate and on a side opposite to the display region with respect to the sealing materials.

11. An image display device according to claim 10, wherein the spatial region is formed on a corner portion of the support body.

12. An image display device according to claim 10, wherein the spatial region is formed on either one of the face substrate side and the back substrate side.

13. An image display device according to claim 10, wherein the spatial region is formed on a side portion of the support body.

* * * * *